United States Patent [19]

Conner

[11] Patent Number: 4,603,312

[45] Date of Patent: Jul. 29, 1986

[54] CIRCUIT BREAKER WITH ADJUSTABLE TRIP UNIT

[75] Inventor: John P. Conner, Brighton Twp., Beaver County, Pa.

[73] Assignee: Westinghouse Electric Corp., Pittsburgh, Pa.

[21] Appl. No.: 714,652

[22] Filed: Mar. 21, 1985

[51] Int. Cl.[4] ..... H01H 75/10

[52] U.S. Cl. ..... 335/42; 335/176; 74/470; 74/522

[58] Field of Search ..... 335/42, 45, 174, 176; 337/57; 74/470, 522

[56] References Cited

U.S. PATENT DOCUMENTS

| | | | |
|---|---|---|---|
| 3,260,822 | 7/1966 | Stephenson, Jr. et al. | 335/42 |
| 3,526,861 | 9/1970 | Walker | 335/35 |
| 3,775,713 | 11/1973 | Walker et al. | 335/45 X |

*Primary Examiner*—L. T. Hix
*Assistant Examiner*—Brian W. Brown
*Attorney, Agent, or Firm*—L. P. Johns

[57] ABSTRACT

A circuit breaker characterized by a housing and a circuit breaker structure within the housing and comprising an electromagnetic trip including a magnetic yoke and armature and means associated with the armature for adjusting the electromagnetic force required to pull the armature to the yoke, whereby changing of the force requirement results in significant reduction in operating time of the trip unit.

8 Claims, 7 Drawing Figures

CIRCUIT BREAKER WITH ADJUSTABLE TRIP UNIT

BACKGROUND OF THE INVENTION

1. Field of the Invention

This invention relates to a circuit breaker within an insulating housing, and more particularly, it pertains to an adjustable mechanism for varying the magnetic trip point and to reduce the trip time.

2. Description of the Prior Art

The trip mechanism of most circuit breakers includes a magnetic trip out having a fixed magnet and a movable armature. A range of currents required to produce magnetic trip is obtained by varying the air gap in the magnetic circuit by means of a two section cam driven plunger. A side effect of this mechanism has been that the operating time at the maximum magnetic setting is longer than the corresponding time at low magnetic settings.

SUMMARY OF THE INVENTION

It has been found in accordance with this invention that a circuit breaker may be provided which comprises an electrically insulating housing including a circuit breaker mechanism supported therein and having a pair of separable contacts, a trip device including a main conductor in electrical series with the contacts also includes a trip member operatively movable to effect automatic openings of the contacts, the trip device also including a shunt conductor connected to provide a parallel current path parallel to a portion of the main conductor for shunting current around said portion of said main conductor, the trip device also comprising a thermal trip and an electromagnetic trip, the thermal trip comprising a bimetal connected to said shunt conductor in a heat-conducting relationship with said shunt conductor and be in an unactuated position, the electromagnetic trip comprises a magnetic yoke and a movable armature, a trip bar movable to the armature being calibrated so that upon occurrence of an overload current in the circuit above a predetermined value, the armature moves towards the yoke to actuate the trip device, adjustable means for adjusting the spacing between the magnetic yoke and the armature and including an adjustable knob having a cam surface, and the adjustable means also including cam follower means extending between the cam and the armature for reducing the trip time, the cam follower means including a first cam follower rod, a second armature follower rod, and an interconnector between the first and second rods, one of the rods being slidably mounted on the interconnector and the other rod being adjustably fixedly mounted thereon in a spaced relation to the one rod, first spring means between the interconnector and one of said rods for folding the rods in spaced relation, second spring means for acting upon the armature in a direction opposite to that of the first spring means, and the adjustable means being calibratable to a force ranging from a force less than to greater than that of the second spring means to preselect the electromagnetic force required to actuate the armature.

The advantage of the device of this invention is that it not only provides a variable magnetic trip point which can be established as a field installation at a modest cost but also provides means to reduce the trip time of the unit.

DESCRIPTION OF THE PREFERRED EMBODIMENT

Figure 1:
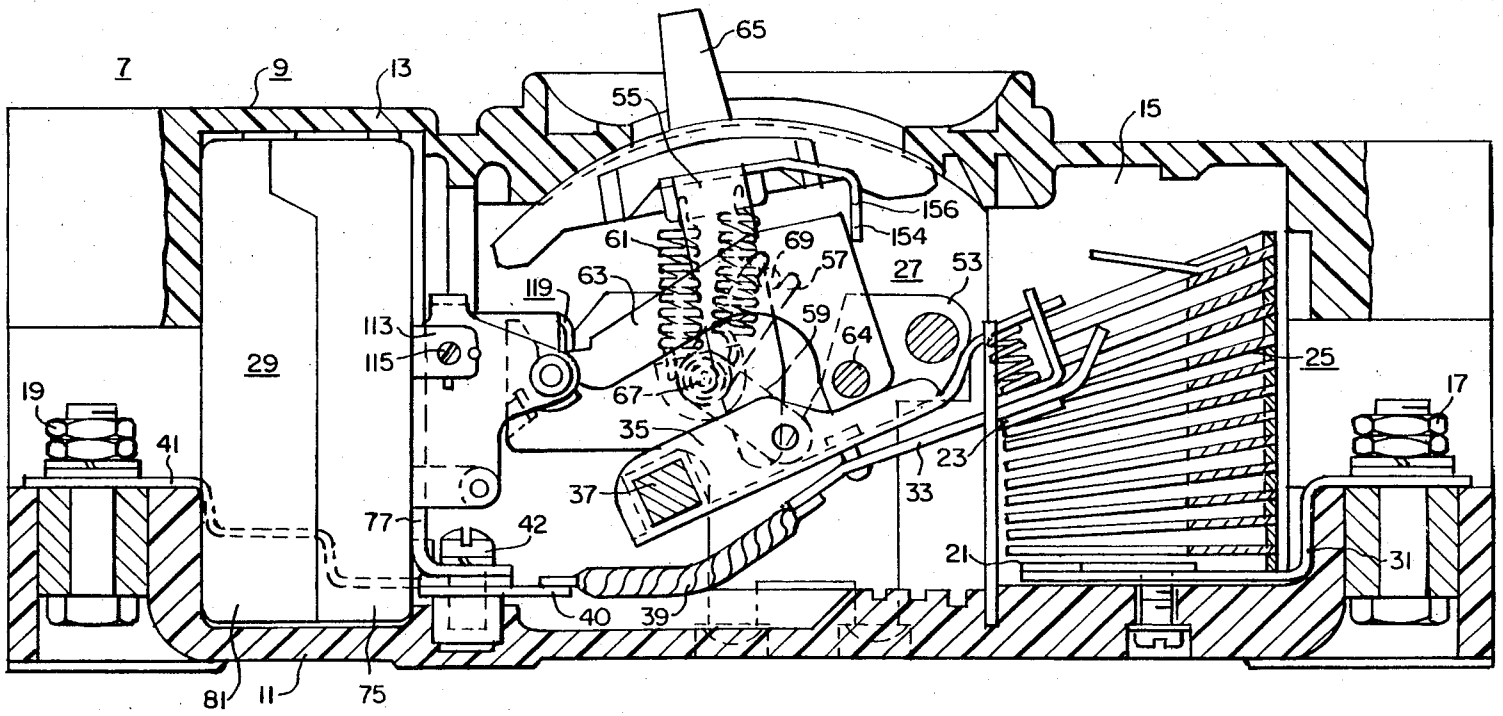
FIG. 1 is a vertical sectional view through a center-pole of a three-pole circuit breaker with a trip device shown in elevation.
Figure 2:
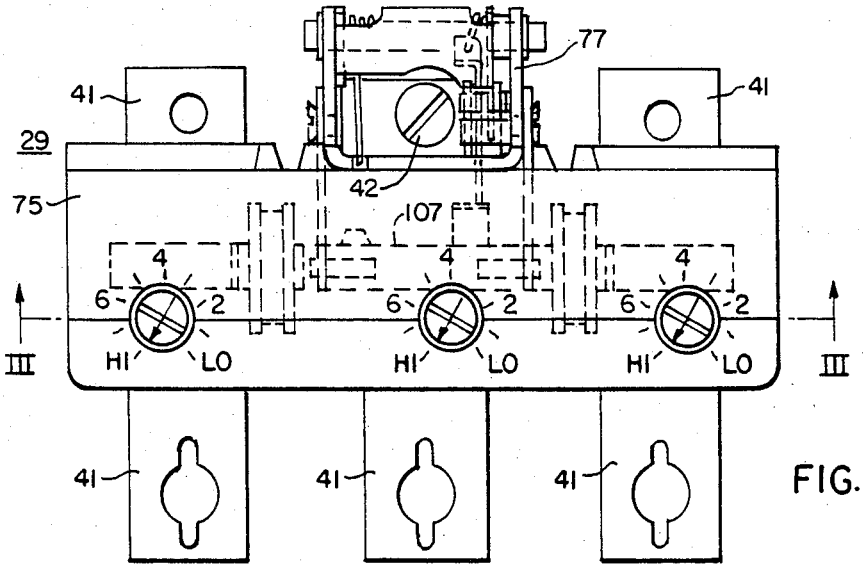
FIG. 2 is a plan view of the removable trip device shown in FIG. 1.
Figure 3:
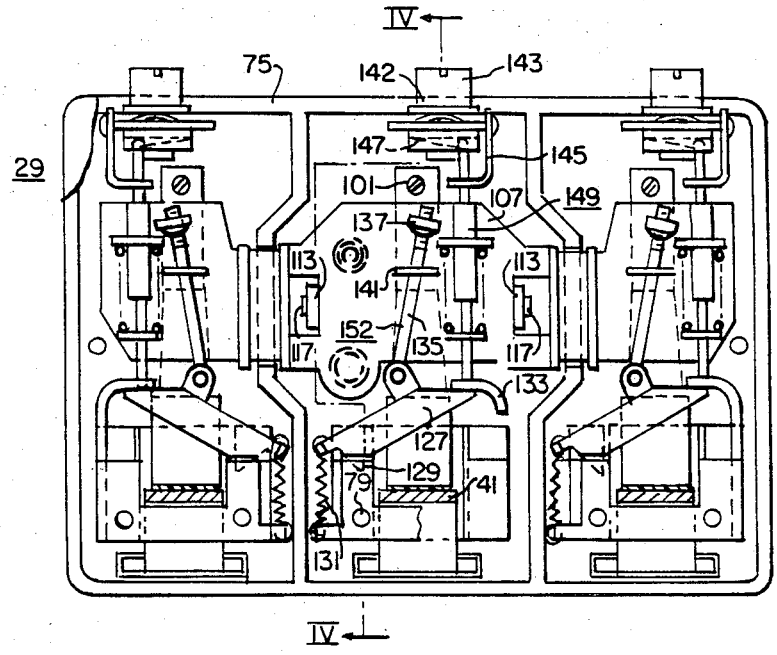
FIG. 3 is a sectional view taken on the line III—III of FIG. 2.

In FIG. 1, a circuit breaker 7 comprises an insulating housing 9 that includes a base 11 and a removable cover 13. The circuit breaker is a three-pole circuit breaker with insulating barrier means 15, formed with the base 11 and cover 13, forming three adjacent compartments for housing the three-pole units. A pair of terminals 17 and 19, are provided in cavities at opposite ends of each pole unit for enabling connection of each pole unit in an electric circuit.

The circuit breaker is of the type more specifically described in the patent to Stevenson, Jr. et al. U.S. Pat. No. 3,260,822. The circuit breaker comprises a stationary contact 21, a movable contact 23, and an arc-extinguisher 25 for each pole unit. A common operating mechanism 27 is provided for simultaneously actuating the three movable contacts to open and closed positions. A trip device, indicated generally at 29, serves to effect automatic opening of the breaker contacts in response to overload conditions in a manner to be hereinafter described.

The terminal 17 is disposed at the outer end of a conducting strip 31 which extends into the housing and rigidly supports the stationary contact 21. The movable contact 23 is mounted on a rigid contact arm 33 that is supported on a switch arm 35 that is connected to an insulating tie bar 37. The tie bar 37 extends across all three pole units of the breaker and supports the switch arms for the several pole units for unitary movement. The tie bar 37 is suitably supported in the housing for movement about an axis to open and closed positions. The contact arm 33 is connected, by means of a flexible conductor 39, to a conductor 40 that engages a main conductor 41 that is secured at one end thereof to the base 11 by means of a screw 42. The main conductor 41 extends through the trip unit 29 and is connected at its outer end to the terminal 19. The main conductor 41 (FIG. 5) is widened at the opposite ends thereof to provide the terminal portions for receiving the screw 42 and terminal 19 in a well known manner.

The operating mechanism 27 is disposed in the center compartment of the housing and is supported on a pair of spaced frame members 53, (only one being shown) which are secured to the base 11. The operating mechanism comprises an inverted generally U-shaped operating lever 55, a toggle comprising toggle links 57, 59, a pair of overcenter springs 61 and a releasable cradle or trip member 63 that is controlled by the trip device 29. The operating lever 55 is pivotally supported at the inner ends of the legs thereof in U-shaped slots in the spaced supporting plates 53. The cradle or trip member 63 is pivotally supported on a pin 64 that is supported between the spaced plate members 53. An insulating handle 65, at the outer end of the lever 55, extends through an opening in the front of the cover 9 to permit manual operation of the breaker.

The toggle links 57 and 59 are pivotally connected together by means of a knee pivot 67. The front end of the link 57 is pivotally connected to the trip member 63 by means of a pin 69. The back end of the toggle link 59 is pivotally connected to the switch arm 35, for the center pole unit, by means of a pin 71. The overcenter springs 61 are connected under tension between the outer end of the operating lever 55 and the knee pivot 67 of the toggle 57, 59 in a well known manner.

The circuit breaker is manually operated to the open position (FIG. 1) by counterclockwise movement of the handle 65 to the "off" position, which movement moves the overcenter springs 61 to cause collapse of the toggle 57, 59 and opening movement of the switch arms 35 for all of the pole units in a well known manner. The breaker is manually closed by reverse or clockwise movement of the handle 65 to the "on" position which movement moves the overcenter springs 61 to erect a toggle 57, 59 to thereby move the switch arms 35 for all of the pole units to the closed position in a manner well known in the art.

The trip device 29 (FIGS. 2–5) comprises an insulating base or support member 75 that is fixedly secured to a rigid metallic supporting bracket 77 by means of a pair of rivets 79. The screw 42 (FIG. 1) fixedly mounts the bracket 77 to the base 11 in the center-pole unit of the circuit breaker to thereby fixedly mount the trip device 29 in position. An insulating cover 81 is removably connected to the base 75 by a pair of screws (not shown), which base 75 and cover 81 are housing parts of the removable trip device 29. The housing 75, 81 is separated into three compartments for housing the three thermal and electromagnetic trips of the three pole units. Only the thermal and electromagnetic trip of the center-pole unit are specifically described, it being understood that the description applies to each of the pole units.

Figure 5:
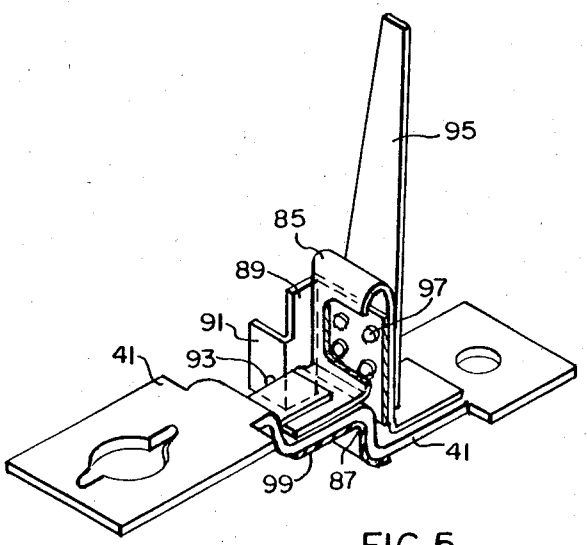
FIG. 5 is a perspective view of parts of the trip device shown in FIGS. 2–4.

A looped conductor 85 (FIGS. 4 and 5) is connected at the opposite ends thereof to the main conductor 41 to provide a parallel current path for shunting a portion of current around an intermediate portion 87 of the main conductor 41. A rigid metallic generally U-shaped bracket 80, having a pair of flanges 91 (only one of which is shown in FIG. 5) at the opposite sides thereof, is secured to the base 75 by two rivets 79 which extend through openings 93 (FIG. 5) in the flanges 91. A bimetal 95 is secured at the lower end to one leg of the looped conductor 85 and to the bight portion of the bracket 89 by four rivets 97. An insulating wrapper 99 surrounds portions of the conductor 41 and loop conductor 85 to insulate these conductors from adjacent parts.

Figure 4:
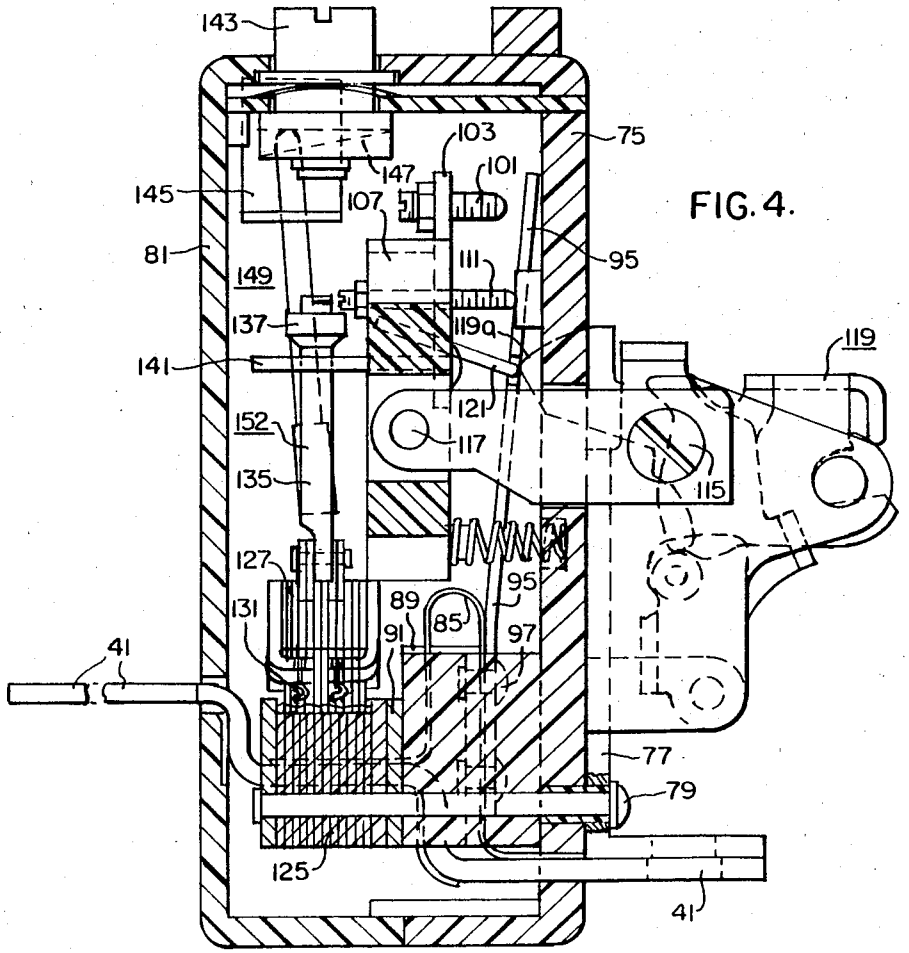
FIG. 4 is an enlarged sectional view taken generally along the line IV—IV of FIG. 3.

In FIG. 4, the free end of the bimetal 95 is disposed opposite a calibrating or adjusting screw 101 that is supported on an extension 103 that is attached to an insulating trip bar 107. A screw 111 is supported on the trip bar to limit (FIG. 4) movement of the trip bar 107. The trip bar 107 is pivotally supported in the housing 75, 81 by a pair of arms 113 that are supported on the bracket 77 by means of screws 115.

The trip bar 107 (FIG. 3) includes a pair of insulating pin portions 117 that extend through openings in the arms 113 to support the trip bar 17 for pivotal movement about the pins 117. A spring 118 (FIG. 4) biases the trip bar 107 in a clockwise direction. In the normal position of the trip bar 107, a latch member 121, that is imbedded in the trip bar 107, engages a latch portion 118 of a latching mechanism that is indicated generally at 119 and that restrains the cradle or trip member 63 in the latched position shown in FIG. 1.

The rivets 79 (FIGS. 3–5) also extend through openings in a laminated U-shaped magnetic core 125. Thus, the rivets 79 of the center-pole unit, fixedly mount the U-shaped magnetic core 125, the rigid bracket 89, and the insulating base 75 to the bracket 77. Only the center-pole unit includes a bracket 77. In each of the two outer pole units the rivets 79 fixedly mount the associated U-shaped magnetic core 25 and the associated bracket 89 to the base 75.

A laminated magnetic armature 127 (FIG. 3) comprises a knife-edge type pivot 129 at one end thereof that is suitably supported in a V-shaped slot in one leg of the associated U-shaped core 125. A pair of springs 131 bias the armature 127 into the open or unattracted position seen in FIG. 3. An elongated arm 135 is pivotally connected to the armature 127 at the lower end thereof, and is provided with a calibrating or adjusting nut 137 at the upper end thereof. The rod or arm 135 extends through an opening in a plate member 141 that is fixed to the insulating trip bar 107. An insulating adjusting knob 143 protrudes through an opening in the front of the trip-device housing 75, 81, and is supported for rotation on a supporting bracket 145 that is fixedly secured to the base 75. The adjusting knob 143 is provided with a cam surface 147 at the lower end thereof.

In accordance with this invention a cam follower structure 149 (FIG. 6) extends between the cam surface 147 and the armature 127. The structure 149 comprises a cam follower rod 151, an armature follower rod 153, and interconnector 155 between the rods, and a compression spring 157. Operation of the structure 149 is set forth more specifically hereinbelow. Suffice it to say, the lower end of the rod 153 extends through an opening in the bracket 133 and engages the front surface of the armature 127. The air gap of the electromagnet can be adjusted by rotating the knob 143 to move the rod 149 longitudinally to thereby pivot the armature 127 to adjust the air gap between the armature 127 and the one leg of the associated magnetic core 125. The armature 125, rod 135, and nut 137 form an armature structure indicated generally at 152 which armature structure is actuated to operate the trip bar in a manner to be hereinafter more specifically described.

When the circuit breaker is closed, the circuit through each pole unit extends from the terminal 19 through the main conductor 41, with the loop conductor 85 (FIGS. 4 and 5) shunting a portion of the current around the intermediate portion 87 of the main conductor 41, through the conductor 40, the flexible conductor 39, the contact arm 33, the movable contact 23, the stationary contact 21, the conducting strip 31 to the other terminal 17.

When the circuit breaker is closed, and a persistent overload, such for example as from 125% of normal current to 10 times normal current, occurs in any of the pole units, the heat generated by the current in the looped shunt conductor 85 is conducted to the bimetal 95, the upper end of which flexes against the screw 101 and rotates the trip bar 107 clockwise (FIG. 4). Thus, this latch 121 releases the latch portion 118 of the latch structure 119 to free the cradle or trip member 63 (FIG. 1). When the circuit breaker is closed, the toggle 57, 59 is erect, and upon release of the cradle 63 the springs 61 operate to rotate the cradle 63 clockwise (FIG. 1) about the pivot 65 to cause collapse of the toggle 57, 59 to open the circuit breaker in a manner well known in the art. During this operation, the handle 65 moves to an intermediate position between the "on" and "off" positions to provide a visual indication that the circuit breaker has been tripped.

The breaker cannot be closed following a tripping operation until the mechanism is reset and relatched. The mechanism is reset and relatched by moving the handle 65 to a position slightly past the full "off" position during which movement an extension 154 on the operating lever 55 engages a shoulder 156 on the cradle 63 pivoting the cradle counterclockwise (FIG. 1). Near the end of this movement, the free end of the cradle 63 wipes past the latch structure 119, and upon release of the handle 65, the latch structure, which is again latched by the latch 121 of the trip bar 107, latches the free end of the cradle 63 in a manner well known in the art. After the cradle 63 has been relatched, the operating handle 65 can be moved to the "on" position to close the contacts in the same manner as was hereinbefore described.

During the above-described thermal tripping operation the bimetal 95 flexes with a time delay so that if the overload is a momentary overload the circuit breaker will not trip out. Upon the occurrence of a severe overload of 10 times or more of the normal current through any of the pole units, the electromagnet 125, 127, which is energized by the full current in the conductors 41, 85, is operated to effect instantaneous attraction of the armature 127 toward the core 125 and the armature 127 pivots on the one leg of the core 125 moving toward the other leg of the core 125. During this movement, the armature structure 152 moves downward and the nut 137 engages the associated projection or plate 141 to pivot the trip bar 107 clockwise (FIG. 4), whereupon the cradle 63 is released to effect a tripping operation as set forth above. The circuit breaker is reset and relatched following an electromagnetic tripping operation in the same manner as was hereinbefore described.

During assembly of the circuit breaker, the thermal trip is calibrated by adjusting the position of the screw 101 (FIG. 4) on the extension 103 of the trip bar 107 to thereby adjust the initial position of the air gap between the bimetal 95 and the adjusting screw 101. The electromagnetic trip is also adjusted during the assembly of the circuit breaker.

Figure 6:
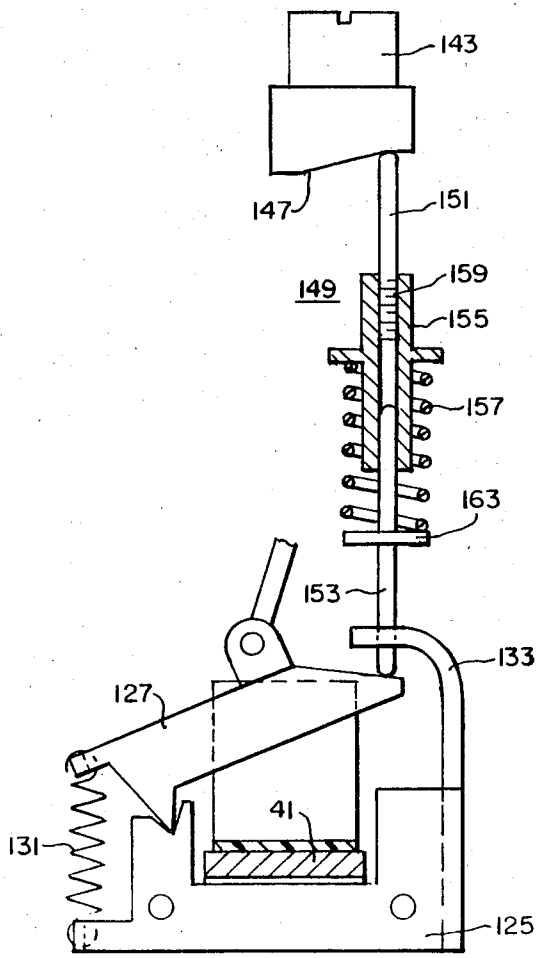
FIG. 6 is an enlarged fragmentary view of the cam follower structure of this invention.

As shown in FIG. 6 the upper end of the rod 151 engages the cam surface 147. The lower end is adjustably fixedly mounted, such as by threaded surface, in the upper threaded section of a bore 159 of the interconnector 155. The upper portion of the armature follower rod 153 is slidably mounted in the lower end of the bore. The lower end of the rod 153 contacts the armature 127. The compression spring 157 extends between flanges 161 and 163 on the rod 153 and the interconnector 155, respectively. The cam follower structure 149 enables finer tuning of the system than is available only with the cam surface 147. The compression spring 157 is used to oppose the effect of the tension spring 131 which has a greater force than that of the spring 157. The resultant force on the armature 127 gives a magnetic pull-in in the desired range of calibration for establishing the maximum magnetic force between the armature and the core or yoke 125. The threaded sections of the rod 149 and the interconnector 155 are used in final calibration for responding to the preselected magnetic flux for pulling the armature. When the cam is rotated from maximum to minimum positions, the spring 157 is compressed and, thereby reduces the current required to cause magnetic trip.

Moreover, as the cam 147 is rotated to depress the cam follower structure to increasingly lower positions, the spring 157 may be compressed sufficiently to a load exceeding the normally greater load of the tension spring 131, thereby reducing an air gap (FIG. 6) that exists between the armature 127 and the core 125. A reduced air gap leads to quicker operation. The degree to which the compression spring 157 is compressed as the cam is rotated is dependent upon the extent to which the cam follower rod 149 is seated in the threaded section of the bore 159.

Accordingly, the cam follower structure 149 is effective to reduce the trip time by either (1) applying a load on the compression spring 157 in an amount up to but not exceeding the inherent load of the tension spring, thereby variably reducing the magnetic trip point of the circuit breaker; or (2) applying a load on the spring 157 greater than that of the spring 131 to thereby reduce the air gap to as much as approximately one-half the usual setting.

The electromagnetic trip is also adjusted by rotating the nut 137 to provide that the nut 137 will engage the associated plate 141 near the end of the armature tripping movement and to provide that the nut 137 will in fact operate to rotate the trip bar 107 to a tripping position near the end of the armature movement.

The trip device 29 is a removable trip device mounted in the circuit breaker by means of the screw 42 (FIG. 1), and the main conductors 41 are subjected to stresses that can move the main conductors when the screws 42 are tightened and loosened and when the terminals 19 (FIG. 1) are tightened or loosened. With the construction of the trip device as disclosed, the movement of the main conductors 41 under stresses will not move the magnetic cores 125, the armature structures 152, the cam follower structure 148, the bimetals 95, or the trip bar 107. The rivets 79 (FIG. 4) fixedly secure the magnetic core 125 and bracket 89 to the base 75 which is fixedly secured to the supporting bracket 77 so that these parts are all fixed with relation to each other. The trip bar 107 is mounted on the supporting arms 113 which are in turn mounted on the bracket 77 so that the pivots 117 of the trip bar are fixed with relation to the supporting bracket 77.

The rod 149 engages the armature 127 and the cam surface of the adjusting knob 143 that is mounted on the bracket 145 that is fixed to the housing base 75 so that the adjusted position of the adjusting rod 149 is fixed with relation to the supported bracket 77. Thus, although there is movement of the structure 149 during adjustment, and although there is movement of the armature 127 during a tripping operation, and although there is movement of the bimetal 95 during a thermal tripping operation, these movements are not movements that will adversely affect the calibration or adjustment of the trip device, and movement of the trip device as a unit or movement of the main conductors 41 under the above-mentioned stresses will not adversely affect the calibration or adjustment of either the thermal trip or the electromagnetic trip. With the bimetal 95 mounted on a portion of the looped conductor 85, and with the looped conductor 85 shunting current around a portion of the main conductor 41, the desirable thermal tripping characteristics are achieved. With the full pole-unit current energizing the electromagnet 125, 127, the desirable electromagnetic tripping characteristics are achieved.

Figure 7:
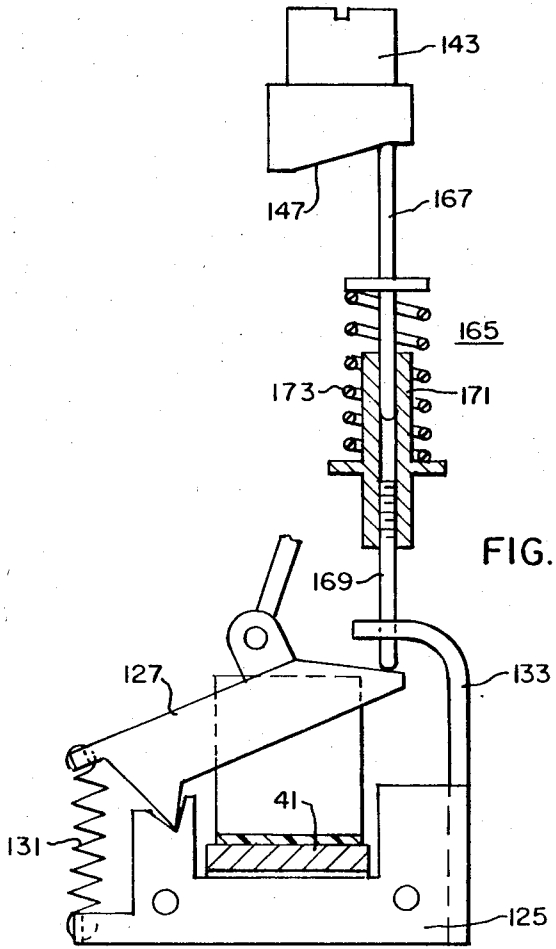
FIG. 7 is an enlarged fragmentary view of another embodiment of the cam follower structure.

Another embodiment of the invention is shown in FIG. 7 in which a cam follower structure 165 is disposed between the cam surface 147 and the armature 127. The structure 165 includes a cam follower rod 167, an armature follower rod 169, an interconnector 171, and a compression spring 173. The cam follower structure 165 is similar in structure and operation to the cam follower structure 149 except that they are inverted.

In conclusion the adjustable trip unit of this invention not only provides a rod and spring arrangement which is used to oppose the effect of the armature spring and which provide a resultant force on the armature that provides a magnetic pull-in within a desired range, and the threaded sections are used in final calibration.

What is claimed is:

1. A circuit breaker comprising a pair of contacts for opening and closing a circuit;

a trip mechanism including a releasable member movable from a latched position to effect automatic opening of the contacts;

the trip mechanism also comprising an electromagnetic trip having a magnetic yoke and an armature biased in an unactuated position of the circuit when energized by a full current in the circuit;

the armature being calibrated so that upon the occurence of an overload current in the circuit above a predetermined value the armature moves toward the yoke to operatively move the releasable member;

adjustable means for adjusting an electromagnetic flux required to actuate the armature and including an adjustable knob having a cam surface;

the adjustable means also including cam follower means extending between the cam and the armature for reducing the trip time;

the cam follower means including a first cam follower rod, a second armature follower rod, and an interconnector between the first and second rods, one of the rods being slidably mounted on the interconnector and the other rod being adjustably fixedly mounted thereon in a spaced relation to the one rod; and first spring means between the interconnector and one of said rods for holding the rods in spaced relation.

2. The circuit breaker of claim 1 in which the armature is biased in an unactuated position by second spring means having a force opposing that of the first spring means to effect a resultant force on the armature substantially equal to predetermined magnetic attraction between the armature and the yoke.

3. The circuit breaker of claim 2 in which the second armature follower rod is slidably mounted with respect to the interconnector.

4. The circuit breaker of claim 3 in which the armature is pivotally mounted, the second spring means biasing the armature to the unlatched position, the first spring means biasing the armature toward the latched position and applying a lesser force than that of the second spring means to effect a predetermined air gap between the armature and the yoke.

5. A circuit breaker for responding to abnormal currents in the conductors of an electrical distribution system and for actuating a circuit breaker to open upon the occurence of predetermined operating conditions, comprising:

an insulating housing;

a circuit breaker mechanism within the housing and comprising a pair of separable contacts, the mechanism including a releasable member movable from a latched position to effect opening of the contacts;

a latch lever movable between latched and unlatched positions of the releasable member and being biased in the latched position;

a stationary magnetic structure for each conductor of the distribution system and including a magnetic yoke and a movable armature;

a trip bar movable to unlatch the latch lever and being biased in the latch position;

adjusting means for adjusting the spacing between the magnetic yoke and the armature and including an adjustable knob having a cam surface;

the adjustable means also including cam follower means extending between the cam surface and the armature for reducing the trip time;

the cam follower means including a first cam follower rod, a second armature follower rod, and an interconnector between the first and second rods and on which one of the rods is slidably mounted and on which the other rod is adjustably fixedly mounted in a spaced relation to the one rod; and first spring means between the interconnector and one of said rods for holding the rods in spaced relation.

6. The circuit breaker of claim 5 comprising second spring means for acting upon the armature in a direction opposite to that of the first spring means, and the force of the second spring means being greater than that of the first spring means to maintain an air gap between the armature and the yoke.

7. The circuit breaker of claim 6 in which the size of the air gap is varied by rotation of the cam, to effect increasing or decreasing pressure on the first spring means.

8. The circuit breaker of claim 6 in which the first cam follower and the interconnector are threadedly connected for calibrating the first spring means to a force ranging from a force less than to greater than that of the second spring means to preselect the electromagnetic force required to actuate the armature.

* * * * *